United States Patent [19]

Glinecke

[11] 4,280,562

[45] Jul. 28, 1981

[54] DISTRIBUTOR FOR FIRE PROTECTION SPRINKLER HEAD

[75] Inventor: Hermann R. Glinecke, Pennington, N.J.

[73] Assignee: Globe Fire Equipment Company, Standish, Mich.

[21] Appl. No.: 94,106

[22] Filed: Nov. 14, 1979

[51] Int. Cl.[3] ..... A62C 37/12

[52] U.S. Cl. ..... 169/39; 169/37; 239/498; 239/500; 239/504

[58] Field of Search ..... 169/37, 38, 39, 40, 169/41, 42, 57, 90; 239/498, 500, 504, 518, 524, DIG. 1

[56] References Cited

U.S. PATENT DOCUMENTS

| | | | |
|---|---|---|---|
| 826,886 | 7/1906 | Murray | 169/39 |
| 828,093 | 8/1906 | Danforth | 169/39 |
| 990,780 | 4/1911 | Rockwood | 169/39 |
| 2,664,956 | 1/1954 | Barz | 169/38 |
| 4,136,740 | 1/1979 | Groos et al. | 169/39 |

FOREIGN PATENT DOCUMENTS 1181972 11/1964 Fed. Rep. of Germany .... 239/DIG. 1

*Primary Examiner*—Robert J. Spar
*Assistant Examiner*—Fred A. Silverberg
*Attorney, Agent, or Firm*—Learman & McCulloch

[57] ABSTRACT

A fire protection sprinkler head construction comprises a frame having at one end a water passage therethrough which normally is closed by a seal maintained in passage sealing position by a thermally sensitive strut which collapses in response to a predetermined increase in its temperature and enables water to flow through the passage. At the other end of the frame is a deflector against which water flowing through the passage impinges and is deflected outwardly in a spray. Encircling the deflector is an annular distributor having a plurality of circumferentially spaced apart blades which intercept water deflected outwardly by the deflector. The blades are twisted at their root ends and bent at their free ends to cause water impinging upon the blades to be divided into relatively large droplets and distributed circumferentially.

14 Claims, 4 Drawing Figures

DISTRIBUTOR FOR FIRE PROTECTION SPRINKLER HEAD

BACKGROUND OF THE INVENTION

The invention relates to a fire protection sprinkler head of the kind adapted to be fitted to a water pipe adjacent the ceiling of a building. The head is constructed and mounted in such manner that, when the ambient temperature rises to a predetermined level, water is discharged from the pipe through the sprinkler head. Conventional sprinkler heads include a frame which supports a deflector member in the path of a stream of water flowing from the head so that water impinging upon the deflector will be directed outwardly and soak an area beneath the sprinkler head. Typical examples of conventional sprinkler heads are illustrated in U.S. Pat. Nos. 2,664,956; 3,770,063; 3,874,456; and 3,998,273.

Among the disadvantages of known sprinkler heads is irregular coverage of the surface to be wetted. This is caused in part by the presence of the frame on which the deflector member is mounted. That is, the frame prevents water issuing from the overhead pipe from reaching all parts of the deflector. As a consequence, the amount of water deflected by the deflector member is greater at certain zones thereof than at others. In some cases no water at all may be deflected from certain zones of the deflector member.

Another disadvantage of known sprinkler heads is that considerable variations may be encountered in the radius of the deflected water stream in the event of changes of water pressure.

A further disadvantage of conventional sprinkler heads is that they provide a spray having a heavier water content nearer the sprinkler than elsewhere, thereby minimizing the fire extinguishing capabilities in zones midway between adjacent sprinkler heads. In addition, such sprinkler heads have a tendency to atomize deflected water, thereby further minimizing the fire extinguishing capabilities of such sprinkler heads.

SUMMARY OF THE INVENTION

A sprinkler head constructed in accordance with the invention overcomes to a large extent the disadvantages referred to above in connection with sprinkler heads known heretofore. This is achieved by the provision of an annular distributor member encircling the deflector member and occupying a position such that deflected water impinges on the distributor. This distributor has a plurality of outwardly and downwardly inclined, circumferentially spaced blades each of which is twisted adjacent its root end and bent adjacent its free end. The blades intercept the deflected water and, due to the twisting and bending of the blades, divert the deflected water from the path it otherwise would take. The diversion of the deflected water results in a substantially evenly distributed water spray, of relatively large droplets, about the periphery of the distributor with a higher density of water at the outer perimeter of the spray than at the inner zone thereof. In addition, the diversion of the water by the blades minimizes atomization of the deflected water.

DESCRIPTION OF THE DRAWINGS

A preferred embodiment of the invention is illustrated in the accompanying drawings, wherein.

DETAILED DESCRIPTION OF THE INVENTION

Figure 1:
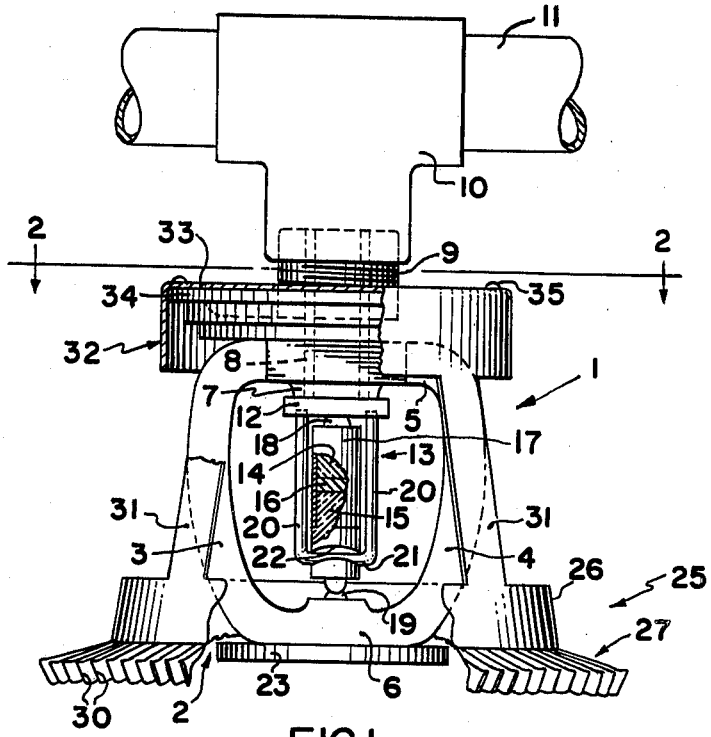
FIG. 1 is a side elevational view, with parts broken away, of a sprinkler head fitted with a distributor constructed in accordance with the invention.
Figure 2:
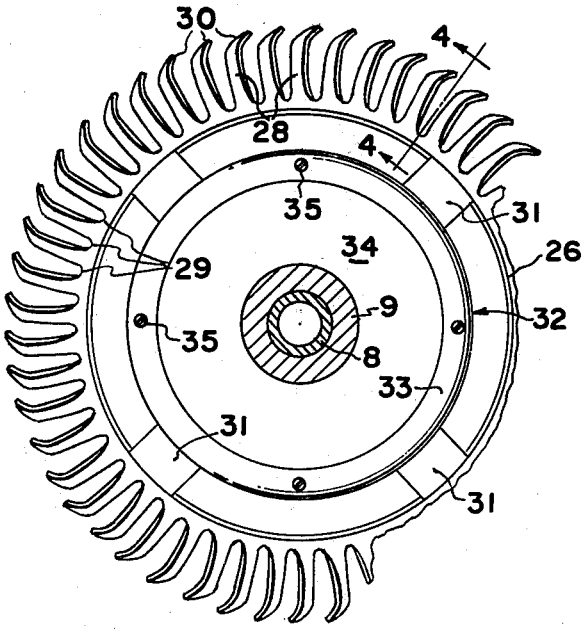
FIG. 2 is a fragmentary sectional view taken on the line 2—2 of FIG. 1.
Figure 3:
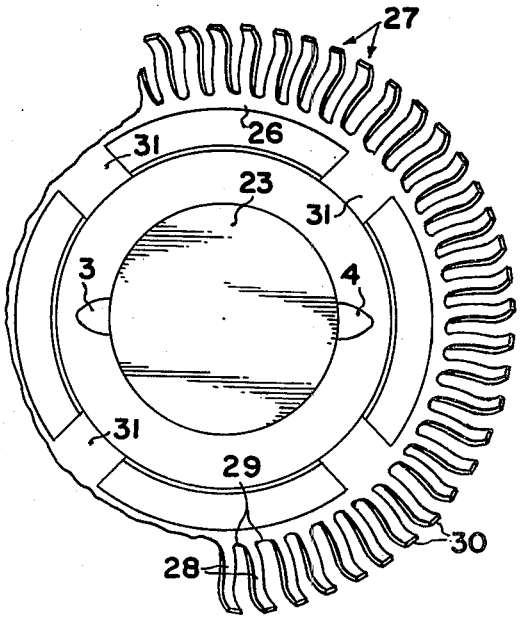
FIG. 3 is a fragmentary bottom plan view of the apparatus.
Figure 4:
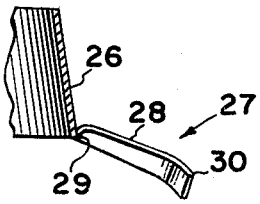
FIG. 4 is a sectional view taken on the line 4—4 of FIG. 2 and illustrating one of the deflector blades.

Apparatus constructed in accordance with the invention is adapted for use in conjunction with a sprinkler head 1 of substantially conventional construction and comprising a frame 2 having generally upright limbs 3 and 4 joined by upper and lower cross arms 5 and 6. The cross arm 5 has an enlargement 7 at its central portion through which extends a sleeve 8 the bore of which forms a passage for water or other fire extinguishing liquid. The sleeve 8 is fixed within an externally threaded coupling 9 which may be received in a correspondingly threaded tee fitting 10 that is joined to a pipe 11 containing water under pressure.

The water passage through the sleeve 8 normally is sealed by a closure disc 12. A thermally sensitive strut 13 having relatively movable body portions 14 and 15 is maintained at a fixed overall length by a eutectic wafer 16. The wafer 16 and adjacent portions of the bodies 14 and 15 are enclosed within a sleeve 17. The exposed end 18 of the member 14 bears against the closure 12 and the exposed end of the body member 15 is accommodated in a seat 19 formed in the frame's cross arm 6. Completing the strut 13 is a U-shaped spring having parallel legs 20 corresponding ends of which are accommodated in recesses formed in the closure 12 and the opposite ends of which are joined by a bight 21 that is accommodated in a groove 22 formed in the body member 15. The strut 13 may be like that disclosed in co-pending commonly owned application Ser. No. 55,457 filed Jul. 6, 1979, or may comprise any one of a number of known fusible struts.

Fitted to the frame's cross arm 6, and on the opposite side of the seat 19, is a preferably flat disc 23 constituting a deflector plate.

The apparatus described thus far is conventional and forms no part of the invention per se, except for the manner in which it cooperates with the apparatus yet to be described. The operation of the apparatus described thus far also is conventional in that, in response to a predetermined increase in the ambient temperature, the eutectic wafer 16 liquefies thereby enabling the strut 13 to collapse by movement of members 14 and 15 toward one another whereupon the closure 12 moves out of sealing engagement with the sleeve 8 permitting water to flow through the passage in the sleeve. The spring arms 20, 21 will eject the strut from the frame 2 thereby permitting the stream of water to impinge upon the deflector 23 and be deflected outwardly of the latter.

Since the arms 3, 4, and 6 lie in the path of water flowing toward the deflector 23 not all portions of the surface of the latter will receive equal amounts of water. As a consequence, the water deflected by the member 23 will not be uniform circumferentially, thereby resulting in an uneven spray pattern being formed. In addition, the heaviest concentration of water in the spray pattern will be closer to the center of the spray pattern than to the perimeter thereof.

Apparatus constructed in accordance with the invention comprises a distributor 25 having an annular frustoconical wall 26 terminating at its lower edge in a plurality of radially extending blades 27 inclined downwardly at an angle of about 30° to the horizontal. Each blade 27 has a body 28 terminating at one end in a root 29 joined to the wall 26 and at its other end in a tip 30. At its juncture with the root 29 the body 28 is twisted at an angle of about 45° and the tip 30 is bent at an angle of about 30°. All of the blades are twisted and bent alike. The significance of the construction of the blades will be explained hereinafter.

Means is provided to mount the annular wall 26 in encircling relation with respect to the deflector 23 and comprises a number of upwardly converging arms 31 joined at corresponding ends to the wall 26 and at their opposite ends to a mounting ring 32 having an inwardly turned flange 33 at its upper edge. The flange overlies a disc 34 that is fixed to the frame arm 5 and is secured thereto by a plurality of screws 35 or the like.

The distributor 25 is supported at a level such that the upper surface of the deflector 23 is coplanar with or slightly above the root ends of the blades 27. As a consequence, water deflected outwardly by the deflector will impinge against the inner surface of the wall 26 and the blades. The presence of the wall 26 and the blades 27 will cause water deflected by the deflector to be diverted from the path it normally would follow due to the inclination of the wall and the body portion 28, and the water further will be diverted by the bent tips 30. The twisting of the blades imparts a swirling movement to the water and the tips 30 form obstructions to laminar flow and create relatively large droplets.

The result of utilization of the distributor 25 is that water is acted upon in such manner that a substantially uniform conical spray pattern is formed, with little atomization, and with the larger droplets appearing adjacent the outer perimeter of the spray. This is a highly desirable result since the spacing between adjacent sprinkler heads may be such that the perimeters of the sprays overlap to a lesser degree than is necessary with conventional sprinkler heads.

Although the density of the spray generated by the distributor 25 will vary according to fluctuations in water pressure, as is true with any sprinkler head construction, the radius of the spray will be fairly uniform, due to the swirling movement of the water, notwithstanding considerable variations in water pressure.

The disclosed embodiment is representative of a presently preferred form of the invention, but is intended to be illustrative rather than definitive thereof. The invention is defined in the claims.

I claim:

1. In a fire protection sprinkler head construction having a frame through a part of which extends a liquid passage, a removable seal for said passage, heat sensitive means normally reacting between said frame and said seal for holding the latter in passage-sealing position but being collapsible in response to a predetermined increase in its temperature to release said seal and permit liquid to flow in a stream through said passage, and a deflector mounted in a position to be engaged by said stream for deflecting said liquid radially and substantially perpendicularly outwardly of said stream, the improvement comprising annular distributing means mounted on said frame independently of said deflector in spaced, encircling relation about said deflector and in a position to intercept liquid deflected by said deflector; and diverting means carried by said distributing means at its periphery and in the path of deflected liquid for diverting such liquid circumferentially of said distributing means.

2. The construction according to claim 1, wherein the mounting means for said distributing means includes a support carried by said frame.

3. The construction according to claim 2 wherein said support nests with said frame.

4. The construction according to claim 1 wherein said diverting means comprises a plurality of spaced apart blades.

5. The construction according to claim 4 wherein each of said blades has a free end and wherein each of said blades is bent adjacent its free end.

6. The construction according to claim 5 wherein each of said blades is bent in the same direction and to substantially the same extent.

7. The construction according to claim 4 wherein each of said blades is twisted.

8. The construction according to claim 7 wherein each of said blades is twisted in the same direction.

9. The construction according to claim 8 wherein each of said blades is twisted to substantially the same extent.

10. The construction according to claim 1 wherein said distributing means comprises a wall radially inward of said diverting means.

11. The construction according to claim 10 wherein said wall is frustoconical.

12. An annular distributor for use in a fire protection sprinkler head having a frame through a part of which extends a liquid passage, a removable seal for said passage, heat sensitive means normally reacting between said frame and said seal for holding the latter in passage-sealing position but being collapsible in response to a predetermined increase in its temperature to release said seal and permit liquid to flow in a stream downwardly through said passage, and a deflector mounted in a position to be engaged by said stream for deflecting said liquid substantially perpendicularly outwardly, said annular distributing member comprising a downwardly diverging, frustoconical wall terminating at its lower edge in a plurality of downwardly inclined twisted fingers; and means carried by said wall for mounting said wall in a position in which said fingers will intercept and further deflect liquid deflected by said deflector.

13. A distributor according to claim 12 wherein all of said fingers are twisted in the same direction.

14. A distributor according to claim 12 wherein each of said fingers is bent adjacent its free end.

* * * * *